United States Patent [19]

Behrends et al.

[11] 4,076,219

[45] Feb. 28, 1978

[54] FLUID PRESSURE-CONTROLLED WINCH MECHANISM

[75] Inventors: Bertwin E. Behrends, East Peoria; Richard F. Hoehn, Pekin; James M. Poirot, Morton, all of Ill.

[73] Assignee: Caterpillar Tractor Co., Peoria, Ill.

[21] Appl. No.: 722,991

[22] Filed: Sep. 13, 1976

[51] Int. Cl.[2] ..... B66D 1/00

[52] U.S. Cl. ..... 254/187.4; 192/18 A

[58] Field of Search ..... 254/166, 187.4, 150 FH, 254/186 R; 192/12 C, 18 A, 87.1; 91/413; 137/596.13, 625.69, 625.67; 191/12.2 R

[56] References Cited

U.S. PATENT DOCUMENTS

| | | | |
|---|---|---|---|
| 2,703,162 | 3/1955 | Keim et al. | 192/126 |
| 2,838,149 | 6/1958 | Burton | 192/126 |
| 2,970,611 | 2/1961 | Hoge | 192/126 |
| 3,841,608 | 10/1974 | Schmitt et al. | 254/166 |
| 3,899,058 | 8/1975 | Pasquini | 192/126 |
| 4,004,779 | 1/1977 | Flesburg | 254/187.4 |

*Primary Examiner*—Trygve M. Blix

*Assistant Examiner*—Kenneth Noland

*Attorney, Agent, or Firm*—Phillips, Moore, Weissenberger, Lempio & Majestic

[57] ABSTRACT

A winch drum carrying a cable is supported by drive mechanism which includes a normally disengaged drive input clutch that is engageable in response to pressurized fluid to reel in cable. A normally engaged disconnect clutch disengages in response to fluid pressure to free the drum for rotation independently of the drive mechanism. A normally engaged brake immobilizes the drive mechanism except when released by fluid pressure. A control valve provides for directing pressurized fluid to appropriate ones or combinations of the clutches and brake as necessary to establish any of four operational conditions including Reel-In, Brake-On, Brake-Off and Disconnect modes of operation. A check valve between the flow lines that connect the control valve to the input clutch and to the brake assures that there is no momentary overlapping of engagements of both the input clutch and the brake when the Reel-In mode of operation is initiated or terminated.

5 Claims, 3 Drawing Figures

FLUID PRESSURE-CONTROLLED WINCH MECHANISM

BACKGROUND OF THE INVENTION

This invention relates to winches having a rotatable drum with drive means for reeling in and releasing a cable or the like. More particularly the invention relates to winch mechanisms in which the drum is driven and controlled by means of fluid pressure-operated clutches and brakes.

An advantageous form of winch mechanism for disposition on a vehicle or elsewhere has an input clutch for selectively transmitting drive from an engine to a rotatable drum and further includes a disconnect clutch for enabling the drum to turn independently of the drive mechanism and also has a brake for selectively immobilizing the mechanism. The input clutch is spring-biased to a disengaged position and engages in response to fluid pressure. Both the disconnect clutch and the brake are spring-biased to engaged positions and are disengageable in response to fluid pressure.

A control valve provides for the selective application of fluid pressure to particular ones or combinations of the clutches and brake to establish any of four operational modes of the winch. These include a Reel-In mode at which the input clutch and also the brake are pressurized and a Brake-On mode at which both clutches and the brake are unpressurized to immobilize the drum. At a Brake-Off mode, only the brake is pressurized enabling a load to pull out cable against the drag of the drive mechanism. At a Disconnect mode, the brake and disconnect clutch is pressurized thereby enabling the drum to be turned freely independently of the drive mechanism so that cable may be withdrawn manually without undue effort.

Difficulties may be encountered in winch mechanisms of this general type at the particular times when the control valve is shifted into the Reel-In position particularly if valve movement into this position occurs slowly. At that time modulated rising fluid pressures are directed to the input clutch through one flow line and to the brake through another flow line. The resulting engagement of the input clutch and disengagement of the brake should be precisely synchronized. If the input clutch engages before the brake releases, drive line shocks, accelerated wear and in extreme cases stalling of the driving engine may occur. If the input clutch engagement is delayed relative to brake relase, a load which may be pulling on the cable may drop abruptly and excessive cable may be withdrawn giving rise to cable slack and other adverse effects. Essentially similar problems may be encountered when the control valve is shifted away from the Reel-In position.

Resolution of this problem is made difficult since pressurized fluid must be applied to the brake at certain modes of operation where it is not applied to the input clutch. This dictates the providing of separate flow lines from the control valve to the input clutch and to the brake. The control valve and fluid lines must then be precisely balanced with respect to providing synchronized pressure increases and decreases to the input clutch and brake if the problems discussed above are to be avoided.

A winch mechanism of the general type to which the invention relates is disclosed in copending U.S. application Ser. No. 662,320 of L. F. Yates et al, filed Mar. 1, 1976, for WINCH WITH FREE WHEELING DRUM and assigned to the assignee of this application, said copending application being a continuation-in-part of application Ser. No. 334,354 filed Feb. 21, 1976, and now abandoned.

SUMMARY OF THE INVENTION

This invention is a winch mechanism of the general type discussed above wherein fluid pressure-operated clutches and a brake are used to establish any of four operational modes. These include a Reel-In mode at which a control valve is shifted to pressurize and engage a normally disengaged input clutch while also pressurizing and releasing a normally engaged brake. In other modes of operation the brake must be pressurized while the input clutch remains unpressurized and thus separate flow passages are provided between the control valve and the input clutch and the brake and also within the control valve itself.

To assure a precise coordination of the operation of the brake with that of the input clutch when the control valve is shifted into and out of the Reel-in position, a specialized control valve construction is utilized, together with a unidirectional flow device such as a check valve, which is connected between the two flow passages that lead from the control valve to the input clutch and to the brake. When the control valve is shifted into the Reel-In position, this causes the same rising fluid pressure which is transmitted to the input clutch to be simultaneously transmitted to the brake thereby assuring synchronization of the engagement of the input clutch with disengagement of the brake. Owing to the check valve or the like this interconnection between the input clutch and the brake does not interfere with the independent pressurization of only the brake during other modes of operation. The structure further assures coordinated release of fluid pressures from the input clutch and the brake at the conclusion of a Reel-In mode of operation by establishing a shared drain passage when the control valve is shifted away from the Reel-In position.

Accordingly, it is an object of this invention to provide a fluid pressure-controlled winch mechanism in which the operation of a drive input clutch and a winch brake are precisely synchronized.

It is an object of the invention to avoid engine stalling and other adverse effects which can arise from overlapping of the input clutch and brake engagements in a fluid pressure-controlled winch mechanism.

It is still another object of the invention to inhibit unwanted release of cable and other adverse effects which can arise as a result of delay between brake release and input clutch engagement in a fluid pressure-controlled mechanism.

The invention, together with further objects and advantages thereof, will best be understood by reference to the following description of a preferred embodiment taken in conjunction with the accompanying drawings.

BRIEF DESCRIPTION OF THE DRAWINGS

In the accompanying drawings:

FIG. 3 is a section view of a control valve and certain other hydraulic circuit elements by means of which fluid pressures are applied to the control devices of FIG. 2 to control the operations of the winch mechanism. FIGS. 2 and 3 may be juxtaposed end to end to form a single continuous drawing in which interconnections between the hydraulic control circuit and the winch mechanism are more readily apparent.

DESCRIPTION OF A PREFERRED EMBODIMENT

Figure 1:
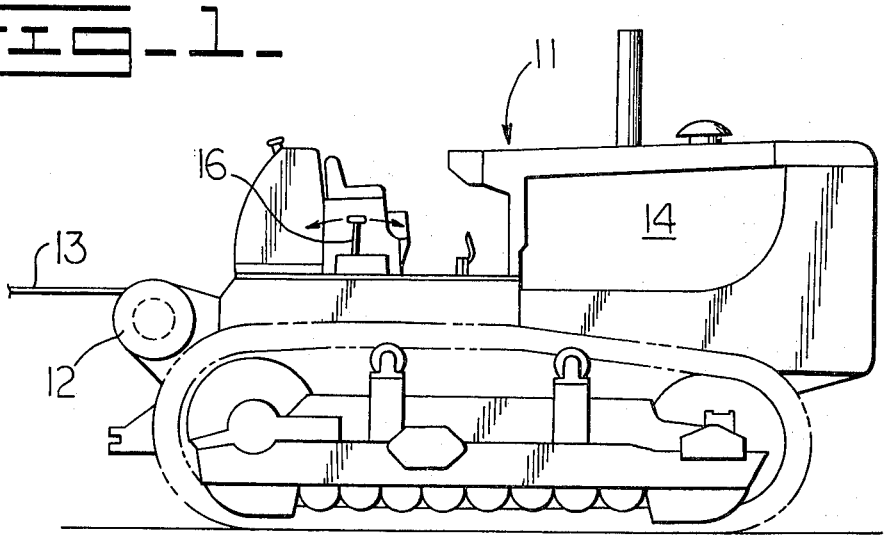
FIG. 1 is a side view of a crawler tractor vehicle equipped with a fluid pressure-controlled winch mechanism.

The invention was originally developed for use in a crawler tractor and is depicted in that context in FIG. 1, although the apparatus may readily be employed on other forms of vehicle or in non-vehicular usages. As shown in FIG. 1, the winch mechanism may typically be mounted at the back of a tractor 11 an includes a rotatable winch drum 12 having a length of cable 13 wound thereon. The winch may be driven by the vehicle engine 14 through mechanism to be hereinafter described in more detail and may be controlled by means of a pivotable lever 16 suitably mounted to be reachable by the operator of the vehicle.

Four different modes of operation may be provided for by manipulation of lever 16 to any of four different positions. At a Brake-On position, the winch drum 12 is immobilized in order to simply hold on to a load winch may be attached to the cable 13 or to drag the load by vehicle movement. A Reel-In mode is also provided for at winch drum 12 is turned to wind in cable 13. Two additional distinct modes of operation provide for the release of cable from the winch drum 12. If cable is to be withdrawn by the weight of a heavy load pulling on the cable it is preferable that there be some limited resistance to rotation of the drum 12. For this purpose a Brake-Off mode is provided at which the drum 12 may rotate but only against the limited resistance provided by the drag of the drive mechanism of the winch system. This limited resistance prevents overly abrupt or erratic release of cable and tends to prevent the drum from acquiring sizable rotational momentum which could cause an excess amount of cable to be released if dropping of an attached load should stop. The other cable release mode is termed the Disconnect mode and is one in which the drum 12 may turn relatively freely without being restrained by the drag of the winch mechanism drive train. This facilitates manual withdrawal of cable from the drum when that is necessary.

Figure 2:
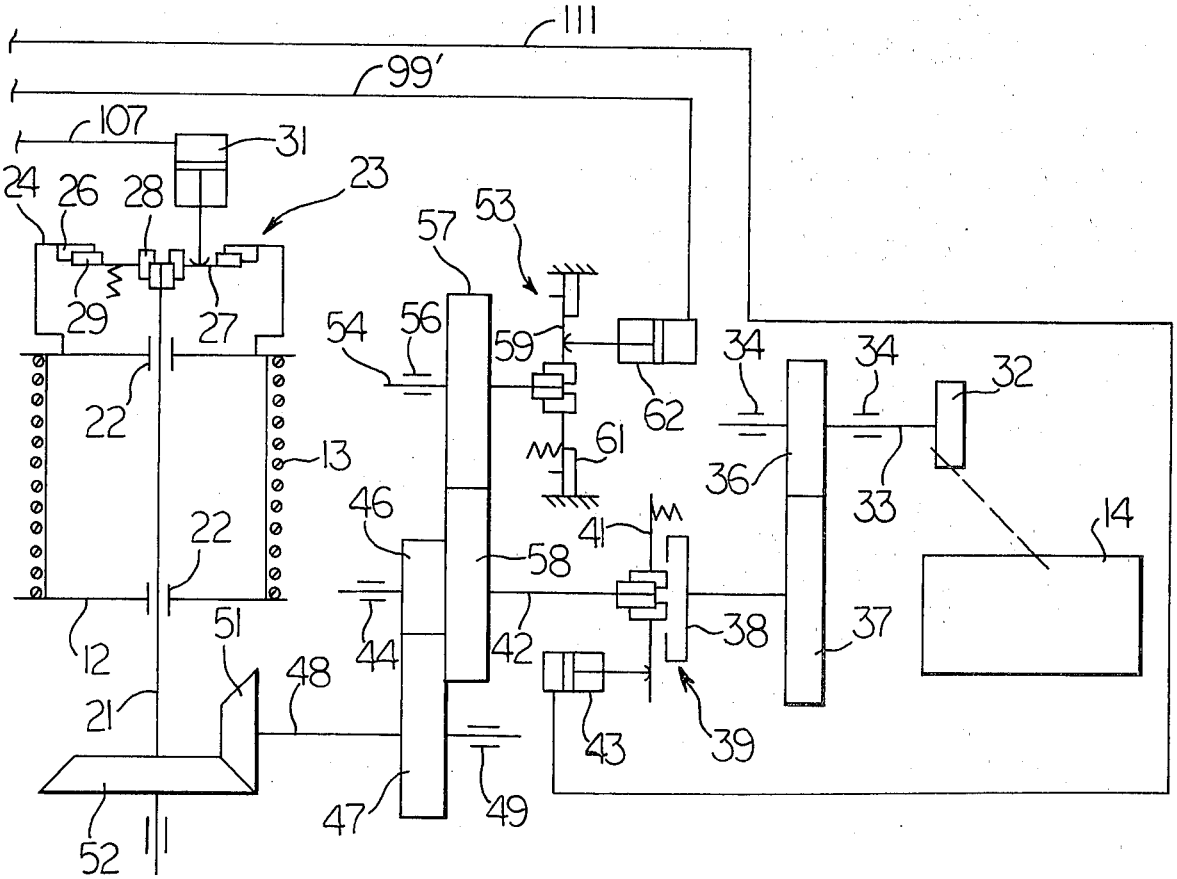
FIG. 2 is a schematic diagram of the winch mechanism of FIG. 1 illustrating drive train elements and control devices of the mechanism.
Figure 5:
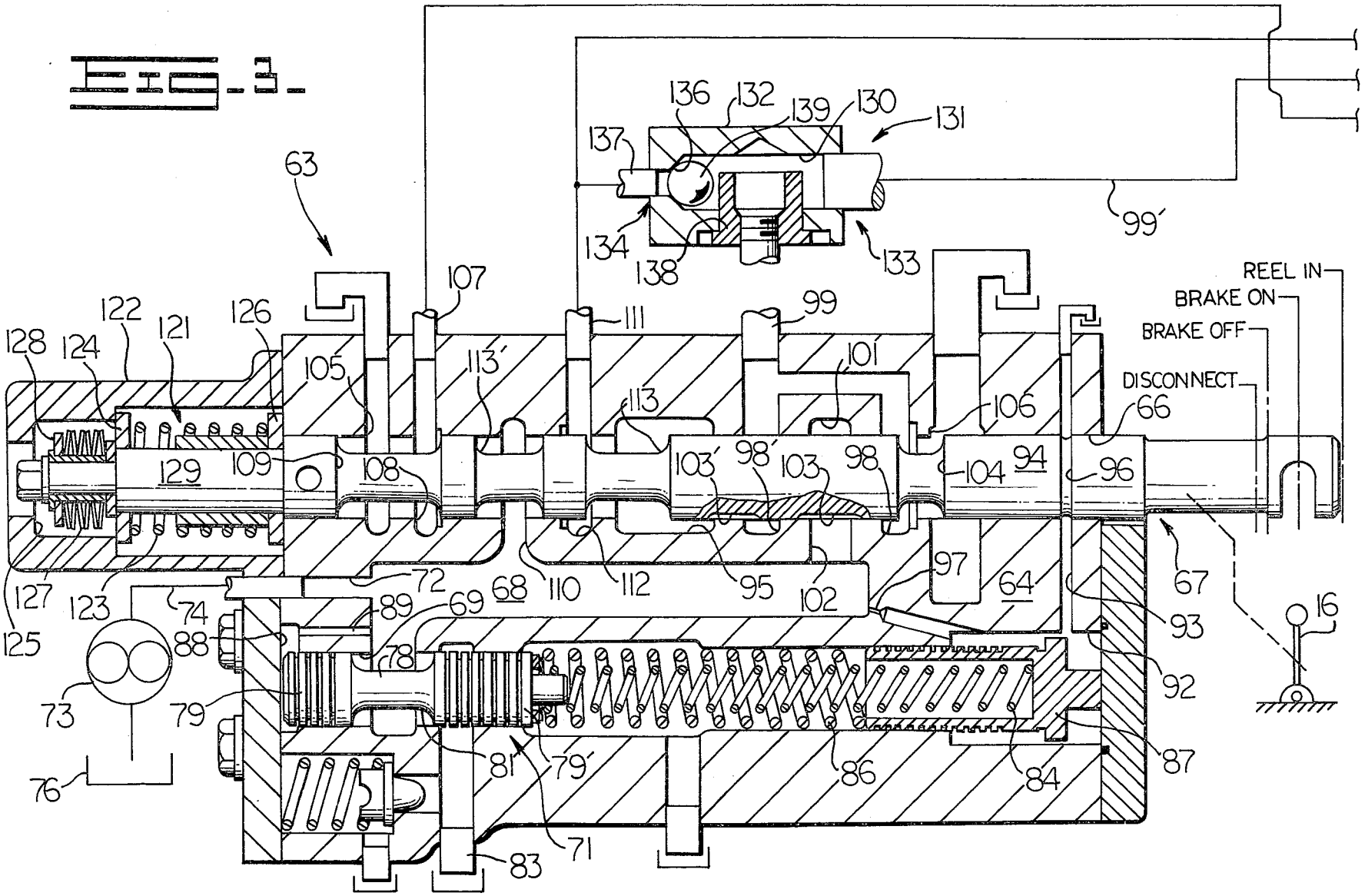

A suitable detailed construction for the winch mechanism including control devices for effecting each of the above-described modes of operation is shown in FIG. 2.

The winch drum 12 may be supported on a rotatable drive shaft 21 by bearings 22. Except in the Disconnect mode of operation, drum 12 is rotationally locked to shaft 21 by a normally engaged jaw clutch 23.

Disconnect clutch 23 may be a jaw clutch of the type in which an annular member 24 having teeth 26 is coupled to the drum while another clutch member 27 is coupled to drive shaft 21 by splines 28 and has teeth 29. The disconnect clutch 23 is spring-biased to a normally engaged position at which teeth 29 engage teeth 26 to couple drum 12 to the drive shaft 21. The disconnect clutch 23 may be selectively disengaged by pressurizing a fluid actuator 31 which then acts against member 27 to disengage teeth 29 from teeth 26.

To transmit drive from engine 14 to drum 12 during the Reel-In mode of operation, the engine turns an input member 32 mounted on an input shaft 33 which is itself supported by bearings 34. A transfer gear 36 on shaft 33 engages another transfer gear 37 which is coupled to an input member 38 of a normally disengaged input clutch 39 that may be of the friction disc type. One or more output discs 41 of input clutch 39 are spline-engaged to an output shaft 42 and are spring-biased towards a position at which the disc or discs 41 are free of engagement with input member 38. Input clutch 39 is selectively engageable by pressurizing a fluid actuator 43 which then urges disc 41 towards input member 38 to effect the engagement.

Output shaft 42 is supported by another bearing 44 and carries a transfer gear 46 that engage still another transfer gear 47. Transfer gear 47 is secured to a shaft 48 supported by another bearing 49. To transmit drive from shaft 49 to the winch drum drive shaft 21, a bevel gear 21 on shaft 48 engages another bevel gear 52 on shaft 21.

In order to immobilize the winch drum 12 at the Brake-On mode of operation, a normally engaged brake 53 is coupled to shaft 42 through a brake shaft 54 supported by a bearing 56. A gear 57 on brake shaft 54 engages another gear 58 which is coupled to shaft 42. Brake 53 may be of the friction disc type and may include one or more brake discs 59 spline-coupled to the brake shaft 54 and spring-biased towards a position at which each disc 59 is urged against a stationary brake disc 61. Brake 53 is selectively disengageable by pressurizing a fluid actuator 62 which then forces disc 59 away from disc 61.

With all of the control devices, specifically actuators 31, 43 and 62, unpressurized, the winch mechanism is in the Brake-On mode of operation at which drum 12 is immobilized by the brake 53. The Reel-In mode of operation is established by pressurizing actuators 43 and 62 as this engages the input clutch while releasing the brake. The Brake-off mode is established by pressurizing only actuator 62 and under that condition the drum 12 may be turned by a load pulling on cable 13 if the pull is sufficiently strong to overcome the drag of the drive mechanism between the drum and the input clutch 39. The Disconnect mode of operation is realized by pressurizing actuator 62 which releases the brake 53 and by pressurizing actuator 31 which then disengages the disconnect clutch 23 to allow the drum 12 to turn freely on shaft 21.

Considering now the control means with which the clutch and brake actuators 31 and 43 and 62 may be selectively pressurized to establish any selected one of the above-described modes of operation, reference should be made to FIG. 3.

A control valve 63 has a valve body 64 provided with a bore 66 in which a valve position selector element formed by a spool 67 is disposed for axial movement in response to pivoting of the operator's control lever 16. Valve body 64 has a pressurized fluid-receiving chamber 68 and has another bore 69 in which a pressure-modulating relief valve assembly 71 is disposed. A fluid inlet passage 72 communicates with chamber 68 and receives pressurized fluid from a source, such as a pump 73, through a supply conduit 74. Pump 73 may be driven by the vehicle engine or other means and draws hydraulic fluid such as oil from a reservoir 76.

Except at the Brake-On position of the control lever 16, the modulating relief valve assembly 71 acts to establish a predetermined maximum fluid pressure level in receiving chamber 68 that is sufficiently high to fully actuate the previously described clutches and brake through the associated actuators. Valve assembly 71 further functions to drop the pressure in chamber 68 to a lower level when the control valve spool 67 is shifted into the Brake-On position and to thereafter produce a gradual controlled rise of the system fluid pressure back up to the maximum level following movement of the spool away from the Brake-On position in either direction. This pressure-modulating action enables a gradual engagement or disengagement of the clutches and brake and thereby acts to reduce shocks, stresses and wear in the system.

The modulating relief valve assembly 71 has a spool 78 disposed for axial movement in bore 69 and which is provided with a pair of spaced-apart lands 79 and 79' separated by a spool groove 81. The portion of bore 69 in the region of spool groove 81 is communicated with fluid-receiving chamber 68 and together with an edge of spool land 79' forms a flow-metering means through which fluid from chamber 68 may be released to a discharge or drain passage 83 to regulate system pressure. A pair of coaxial compression springs 84 and 86 are disposed within bore 69 and act between the end of spool 78 and a load piston 87 at the opposite end of the bore 69 to urge the spool towards a position at which land 79' blocks the release of fluid from chamber 68 to discharge passage 83. The force of springs 84 and 86 on spool 78 is opposed by fluid pressure in an end chamber 88 of bore 69 which is communicated with chamber 68 by a passage 89.

The position of valve spool 78 is determined by the extent to which fluid pressure in chamber 88 acting on the spool is able to overcome the opposing force of springs 84 and 86 on the spool to permit a controlled release of fluid from the receiving chamber 68. The springs 84 and 86 are selected to establish a predetermined base pressure within chamber 68 which is below that required to fully actuate the previously described clutches and brake. Thus with the load piston 87 fully to the right as viewed in FIG. 3, the pressure within chamber 88 is able to shift spool 78 sufficiently to discharge fluid at a rate which keeps the pressure in chamber 68 at the low base value. If load piston 87 is then shifted leftwardly to increase the spring force on spool 78, the pressure within chamber 68 and thus in chamber 88 also must rise to a higher value in order to force the spool 78 to the position at which fluid can continue to be released. Thus system pressure may be raised in a modulated manner by shifting load piston 87 progressively to the left as viewed in FIG. 3.

To control the load piston 87 so that system pressure is minimal at the Brake-On setting of lever 16 and rises in a modulated manner when the lever is moved away from that position in either direction, a chamber 92 behind the load piston at the end of bore 69 is communicated with a drain through a passage 93 which extends across valve spool bore 66. The selector valve spool 67 has a land 94 which blocks drain passage 93 at all positions of the selector spool 67 other than the Brake-On position. At the Brake-On position, a groove 96 on land 94 enables fluid to discharge from load piston chamber 92 through passage 93.

Load piston chamber 92 receives fluid from receiving chamber 68 through a passage having a flow orifice 97. This restricted flow of pressurized fluid into the load piston chamber 92 does not move the load piston 87 when the selector spool 67 is in the Brake-On position since the load piston chamber is vented at that time through the drain passage 93 and spool groove 96. If the selector spool 67 is shifted away from the Brake-On position in either direction, drain passage 93 is then blocked by spool land 94. The flow of pressurized fluid through orifice 97 then gradually raises the pressure in chamber 92 causing the load piston 87 to move progressively to the left as viewed in FIG. 3 thereby gradually raising the system pressure within receiving chamber 68 as described above.

Accordingly, a shift of the selector lever 16 in either direction away from the Brake-On position is followed by a modulated rise of system pressure. The system pressure then stabilizes at a high level until the control lever 16 is again shifted to the Brake-On position at which the fluid pressure behind the load piston 87 is relieved to reset the modulating relief valve assmebly.

Considering now the action of the selector spool 67 in distributing pressurized fluid to appropriate ones of the clutches and brake at the various positions of the spool and control lever 16, bore 66 has a pair of spaced-apart interconnected grooves 98 and 98' which communicate with a flow line 99 through which fluid is supplied to and released from the brake actuator 62 of FIG. 2.

Referring again to FIG. 3, bore 66 has an additional groove 101 situated between grooves 98 and 98' and which receives pressurized fluid from chamber 69 through a passage 102. Spool 67 has a series of flow-metering grooves 103 located to increasingly release pressurized fluid from groove 101 into groove 98 or 98' when the selector spool is shifted in either direction away from the Brake-On position. Through line 99 this pressurizes the brake actuator to release the brake at all other settings of the control valve. A groove 104 is located on selector spool 67 to vent groove 98 into an adjacent drain groove 106 when the selector spool is at the Brake-On position. This depressurizes outlet line 99 enabling the brake to engage. To avoid an overly abrupt engagement of the brake as spool 67 is shifted from the Brake-off position towards the Brake-On position, additional metering grooves 103' on spool 67 are located to gradually release fluid from bore groove 98' to drain groove 95 prior to the time when spool groove 104 comes into register with drain groove 106.

Another outlet line 107 of the control valve is communicated with the disconnect clutch actuator 31 and is pressurized at the disconnect position of selector spool 67 while being vented to drain at all other positions of the spool. For this purpose, control valve bore 66 has another groove 108 communicated with outlet line 107 and situated near another drain groove 105. Selector spool 67 is provided with a groove 109 positioned to communicate groove 108 with drain groove 105 at all positions of the spool except for the disconnect position. At the disconnect position, the spool groove 109 isolates groove 108 from drain groove 105 and another spool groove 113' communicates groove 108 with a groove 110 of bore 66 which is communicated with fluid-receiving chamber 68. Thus outlet line 107 to the disconnect clutch actuator is vented at all positions of the selector spool except the disconnect position at which it becomes pressurized to disengage the disconnect clutch.

The input clutch actuator outlet line 111 of the control valve is communicated with still another groove 112 of bore 66. A groove 113 is located on spool 67 to communicate groove 112 with a drain groove 95 at all positions of the spool other than the Reel-In position. At the Reel-In position spool groove 113' has been shifted rightwardly as viewed in FIG. 3 sufficiently to communicate groove 112 with groove 110 which is in communication with the fluid-receiving inlet 68. Thus the input clutch actuator is pressurized, to engage the input clutch at the Reel-In position. At all other settings of the control valve the input clutch actuator is vented to drain groove 95.

From the foregoing it may be seen that the clutch and brake pressurizations and depressurizations which are needed to effect the several described modes of winch operation may be realized by simply shifting the operator's control lever 16 between the appropriate one of the four positions of the lever. In order to restore the selector spool 67 and control lever 16 to the Brake-On position automatically when the lever is released, a centering spring assembly 121 is situated in a housing 122 adjacent the end of bore 66. Movement of the valve spool in either direction away from the Brake-On position compresses a spring 123 between annular elements 124 and 126 carried on a reduced-diameter extension 129 of spool 67 within housing 122. Thus the spring 123 constantly exerts a force tending to return the spool 67 to the Brake-On setting and does return the spool to that position except when the operator holds the control lever 16 in some other position.

In order that the operator may sense kinesthetically when the control lever 16 has been shifted through the Brake-Off position and is about to enter the Disconnect position, a series of compressible belleville springs 127 together with an annular element 128 are disposed coaxially on the end of reduced-diameter extension 129 of spool 67 within housing 122. Leftward movement of the spool 67 as viewed in FIG. 3 causes element 128 to contact an end wall 125 of housing 122 at the point when the spool is about to reach the disconnect setting. Still further movement of the valve spool 67 into the Disconnect setting requires compression of the belleville springs 127. This creates an abruptly increased resistance to further movement of the valve spool, thereby alerting the operator by feel that the winch drum is about to be freed of any significant resistance to rotation. The above-described spring mechanisms within housing 122, which act on the selector spool 67, are described and claimed in copending application Ser. No. 574,807 of Edward E. Flesburg filed May 5, 1975 for WINCH AND FLUID CONTROL SYSTEM THEREFOR and assigned to the assignee of the present application and which issued Jan. 25, 1977 as U.S. Pat. No. 4,004,779.

To synchronize the engagements and disengagements of the input clutch and the brake at the beginning and end of a Reel-In mode of operation, a unidirectional flow valve or check valve 131 is connected between the two conduits 111 and 99 through which the control valve 63 is coupled to the input clutch actuator 43 and to the brake actuator 62.

In the present example, check valve 131 has a valve body 132 with a bore 130 which is of greater diameter at one end 133 than at the other end 134 with the reduction in diameter occurring at a conical annular valve seat portion 136 of the bore. A flow conduit 137 communicates the smaller-diameter end 134 of the bore with the control valve outlet line 111 which connects with the input clutch actuator. Brake outlet line 99 from the control valve communicates with bore 130 of the check valve through a fitting 138 at the side of housing 132 which projects a distance into the central region of the bore. A continuation 99' of the outlet line 99 extends from the larger-diameter end 133 of the bore to the brake actuator 62. To provide a check valve action, a spherical valve element or ball 139 is disposed in bore 130 adjacent valve seat 136 and is confined to the valve seat region of the bore by the inner end of fitting 138. The ball 139 is forced away from seat 136 when the fluid pressure within line 111 exceeds that in line 99 and this enables fluid to flow from line 111 to lines 99 or 99'. Under conditions where the fluid pressure in line 99 exceeds that in line 111, the ball 139 is forced against seat 137 to block movement of fluid from line 99 to line 111. As line 99 may under some conditions be required to serve as a drain path for a portion of the flow from input clutch line 111 as well as for the flow from the brake, line 99 may be of greater cross-sectional area than line 111.

In operation, the check valve 131 and the above-described structural provisions within control valve 67 act to assure that engagement of the input clutch is precisely coordinated with disengagement of the brake when the selector spool 67 is moved into the Reel-In setting. The structure further acts to assure synchronization of engagement of the brake with release of the input clutch when the selector spool is subsequently moved away from the Reel-In position.

As the selector spool 67 is moved away from the Brake-On position and approaches the Reel-In position, metering grooves 103 begin to admit pressurized fluid from passage 102 to groove 98 from which it is transmitted to the brake actuator to begin release of the brake. At this time, groove 113' of the selector spool has moved to a position at which pressurized fluid from groove 110 begins to be admitted into line 111 to commence engagement of the input clutch. Also at this time, the pressure-modulating valve assembly 71 initiates a gradual rise of system pressure as previously described. The above-described structure assures that there is no significant imbalance of pressure at the input clutch actuator and the brake actuator during this stage of operation.

While fluid pressure to disengage the brake is basically supplied from control valve 63 through brake outlet 99, if there should be any significant greater pressure in the input clutch line 111 at any stage of operation, fluid may flow through check valve 133 to transmit the higher pressure to the brake actuator as well. Thus a condition where the input clutch engages in advance of disengagement of the brake cannot occur and adverse effects such as stalling of the driving engine are avoided.

The above-described control valve and check valve structure also assures synchronization of engagement of the brake with disengagement of the input clutch at the conclusion of a Reel-In cycle of operation when the selector valve spool 67 is shifted back toward the Brake-On position. Basically the desired disengagement of the input clutch and engagement of the brake is effected by the control valve through release of fluid pressure from lines 111 and 99 respectively. If pressure should be relieved through the brake line 99 faster than through the input clutch line 111, check valve 131 again opens to establish a shared drain path through line 99 thereby synchronizing the pressure decreases at the input clutch actuator and the brake actuator.

While the invention has been described with respect to a specific preferred embodiment, it will be apparent that many modifications are possible and it is not intended to limit the invention except as defined in the following claims.

What is claimed is:

1. A winch mechanism comprising:

a rotatable drum for receiving and releasing a cable, drive means for supporting said drum and for selectively transmitting rotary drive thereto, said drive means having a normally disengaged input clutch which is engageable in response to fluid pressure and further having a normally engaged brake for stopping rotation of said drive mean and said drum and which releases in response to fluid pressure, a source of pressurized fluid, a first flow line for transmitting pressurized fluid to said input clutch and a second flow line for transmitting pressurized fluid to said brake, a control valve connected between said source of pressurized fluid and said first and second flow lines and having first outlet means communicated with said first flow line and second spaced-apart outlet means separately communicated with said second flow line, and having a valve position selector element movable to a Brake-On position at which both of said outlet means are isolated from said source of pressurized fluid and communicated with fluid drain means, said selector element also being movable to a Reel-In position at which pressurized fluid from said source is transmitted to both of said first and second outlet means, and a unidirectional flow valve connected between said first and second flow lines and having means for enabling fluid flow therebetween from said first flow line to said second flow line but which blocks fluid flow from said second flow line to said first flow line, said unidirectional flow valve providing for a drain of fluid from said first flow line, as well as, said second flow line if the pressure in said first flow line exceeds that in said second flow line following movement of said position selector element away from said reel-in position.

2. The combination defined in claim 1 wherein said valve position selector element of said control valve is further movable to a Brake-Off position at which said first outlet means and said first flow line is communicated with a drain while said second outlet means and said second flow line is communicated with said source of pressurized fluid.

3. The combination defined in claim 1 wherein said control valve of said winch mechanism has a fluid-receiving chamber communicated with said source of pressurized fluid and has modulating means for reducing the pressure within said chamber when said valve position selector element is at said Brake-On position and for producing a rise of said pressure within said chamber when said valve position selector element is shifted away from said Brake-On position.

4. The combination defined in claim 1 wherein said unidirectional flow valve comprises a valve body having a bore therein which is communicated with said second flow line and which has an annular valve seat formed in said bore and communicated with said first flow line, said unidirectional flow valve further having a spherical valve element disposed in said bore to seat against said valve seat when the pressure in said second flow line exceeds the pressure in said first flow line, and wherein at least the portion of said second flow line extending between said unidirectional flow valve and said control valve is of greater diameter than the portion of said first flow line extending therebetween.

5. The combination defined in claim 1 wherein said unidirectional flow valve comprises a valve body having a bore therein which is communicated with said second flow line and which has an annular valve seat formed in said bore and communicated with said first flow line, said unidirectional flow valve further having a spherical valve element disposed in said bore to seat against said valve seat when the pressure in said second flow line exceeds the pressure in said first flow line, and wherein one portion of said second flow line is connected between said brake and one end of said bore of said unidirectional flow valve body with said valve seat being situated at the other end of said bore, and wherein another portion of said second flow line is connected between said control valve and an intermediate region of said bore and extends into said intermediate region thereof to retain said spherical valve element near said other end of said bore.

* * * * *